US007972027B1

(12) United States Patent
Hatfield

(10) Patent No.: US 7,972,027 B1
(45) Date of Patent: Jul. 5, 2011

(54) ILLUMINATED DOOR

(76) Inventor: John D. Hatfield, Reno, NV (US)

( * ) Notice: Subject to any disclaimer, the term of this patent is extended or adjusted under 35 U.S.C. 154(b) by 349 days.

(21) Appl. No.: 12/175,593

(22) Filed: Jul. 18, 2008

(51) Int. Cl.
*F21V 21/00* (2006.01)

(52) U.S. Cl. ..... 362/217.12; 362/217.1; 362/217.2; 362/217.3; 362/217.4; 362/217.6; 362/217.7; 362/217.8; 362/217.9; 362/217.11; 362/217.13; 362/432; 362/217.5

(58) Field of Classification Search .. 362/217.1–217.13, 362/432, 217.08, 260, 127, 132–134, 249.01, 362/249.07, 249.11, 249.12, 382, 384, 387, 362/394, 403, 418, 430
See application file for complete search history.

(56) References Cited

U.S. PATENT DOCUMENTS

| | | | | |
|---|---|---|---|---|
| D292,792 | S | 11/1987 | Henry | |
| 6,084,358 | A * | 7/2000 | Dolson | 315/226 |
| 6,220,726 | B1 * | 4/2001 | Gordin | 362/247 |
| 6,346,889 | B1 | 2/2002 | Moss | |
| 6,367,204 | B1 | 4/2002 | Eichler | |
| 6,395,369 | B1 | 5/2002 | Randone | |
| 6,572,238 | B1 | 6/2003 | Johnson | |
| 2005/0225979 | A1 * | 10/2005 | Robertson et al. | 362/240 |
| 2006/0027342 | A1 | 2/2006 | Maher | |
| 2008/0030982 | A1 * | 2/2008 | Warton et al. | 362/219 |

* cited by examiner

*Primary Examiner* — Diane I Lee
*Assistant Examiner* — William J Carter

(57) ABSTRACT

The invention is a light kit that attaches to the interior portion of garage door panels in order to illuminate the garage when either the garage door is open or closed. The kit includes a plurality of lights with corresponding mounting brackets, a watt reducer, lighting box, and a spring-loaded electrical wiring system.

4 Claims, 6 Drawing Sheets

ILLUMINATED DOOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The invention relates to the field of sectional garage doors, more specifically, a sectional garage door that is outfitted with a plurality of lights along the interior side of the garage door such that the interior of the garage is illuminated when the garage door is up or down.

B. Discussion of the Prior Art

As a preliminary note, it should be stated that there is an ample amount of prior art that deals with garage door lighting systems. As will be discussed immediately below, no prior art discloses a sectional garage door-mounted lighting system that includes a spring-loaded electrical wiring system to constantly supply power to the lights regardless of the position of the garage door.

The Eichler Patent (U.S. Pat. No. 6,367,204) discloses a garage door mounted lighting system with a power supply. However, the garage door of the Eichler Patent does not direct a plurality of lights along the interior of the garage door in order to illuminate the garage.

The Johnson Patent (U.S. Pat. No. 6,572,238) discloses an illuminated and decorative garage door cover assembly. However, the garage door assembly is not directed to illuminating the interior of the garage.

The Randone Patent (U.S. Pat. No. 6,395,369) discloses a battery powered illuminated garage door message banner. However, the garage door message banner is not directed to illuminating the garage.

The Maher Patent Application Publication (U.S. Pub. No. 2006/0027342) discloses a garage door formed from a kit having a plurality of door sections with light-transmitting panels mounted thereon and hinges connecting the sections. However, the kit of the Maher publication includes the garage door and is not directed to a kit that attaches onto an existing garage door.

The Moss Patent (U.S. Pat. No. 6,346,889) discloses a security system for an automatic garage door including an indicator light warning signal generating device mounted on the interior of a garage door panel. However, the light warning signal generating device of the Moss Patent does not illuminate the interior of the garage when either a warning signal is generated or when no warning signal is generated.

The Henry Patent (U.S. Pat. No. Des. 292,792) illustrates an ornamental design for a motor housing for a garage door operator, which does not depict a lighting system that is mounted to the interior panels of a garage door.

While the above-described devices fulfill their respective and particular objects and requirements, they do not describe a garage door panel-mounted lighting system that provides for the advantages of the garage door panel-mounted lighting system. In this regard, the garage door panel-mounted lighting system departs from the conventional concepts and designs of the prior art.

SUMMARY OF THE INVENTION

The invention is a light kit that attaches to the interior portion of garage door panels in order to illuminate the garage when either the garage door is open or closed. The kit includes a plurality of lights with corresponding mounting brackets, a watt reducer, lighting box, and a spring-loaded electrical wiring system.

An object of the invention is to provide a garage door panel-mounted lighting system that comes in a plurality of sizes to accommodate differing garage door panel sizes.

A further object of the invention is to provide a box that supports the required componentry of the lighting system.

A further object of the invention is to provide a spring-loaded electrical wiring system that provides electricity to the lighting system irregardless of whether the garage door is up or down.

These together with additional objects, features and advantages of the garage door panel-mounted lighting system will be readily apparent to those of ordinary skill in the art upon reading the following detailed description of presently preferred, but nonetheless illustrative, embodiments of the garage door panel-mounted lighting system when taken in conjunction with the accompanying drawings.

In this respect, before explaining the current embodiments of the garage door panel-mounted lighting system in detail, it is to be understood that the garage door panel-mounted lighting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the garage door panel-mounted lighting system. It is therefore important that the claims be regarded as including such equivalent construction insofar as they do not depart from the spirit and scope of the garage door panel-mounted lighting system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
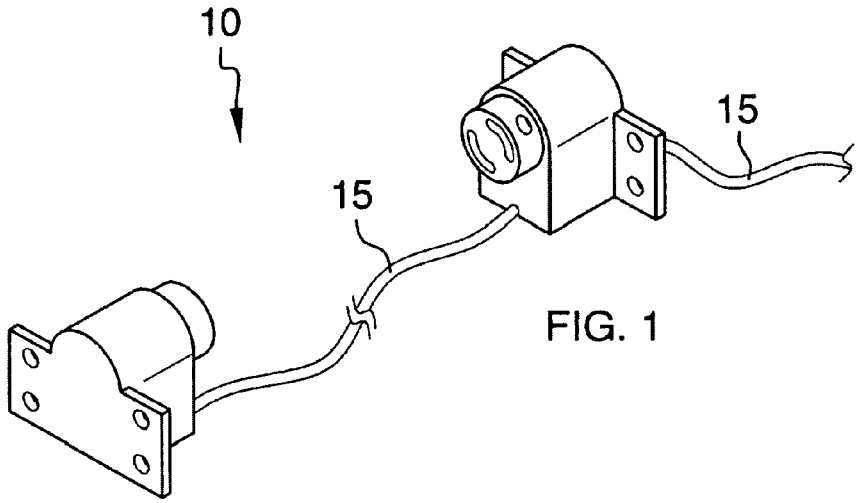
FIG. 1 illustrates a view of a light mounting bracket.
Figure 2:
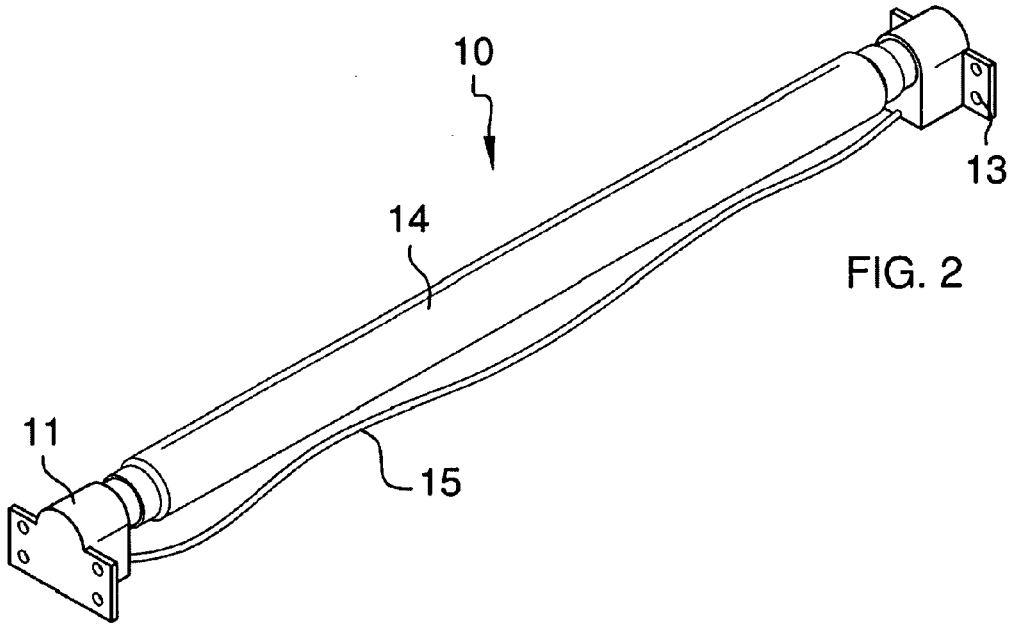
FIG. 2 illustrates a view of a light mounting bracket and a light.
Figure 3:
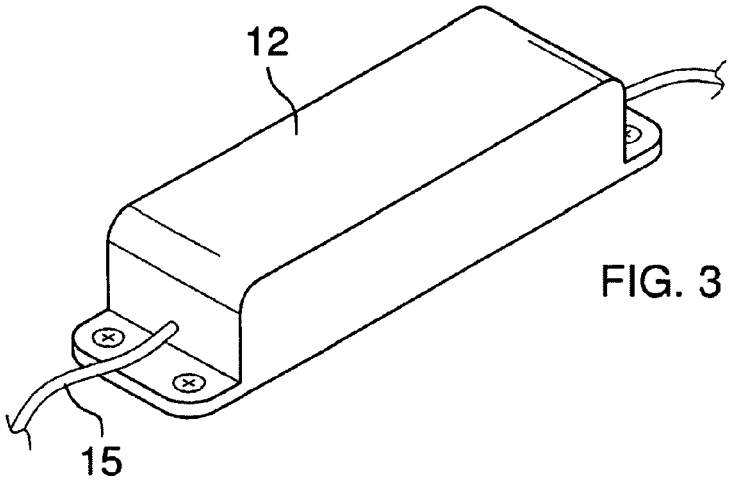
FIG. 3 illustrates a view of the watt reducer.

Detailed reference will now be made to a main embodiment of the present invention, examples of which are illustrated in FIGS. 1-7C. A garage door panel-mounted lighting system 10 (hereinafter invention) includes a plurality of light mounting brackets 11, a watt reducer 12.

The light mounting brackets 11 can mount to the interior surface of a garage door 30 by a plurality of mounting holes and corresponding screws 13. It shall be noted that other fastening means may be employed to attach the light mounting brackets 11 to the garage door 30 and comprise screws, nails, bolts, welding, gluing, magnets, and like fastening means.

The invention 10 depicts the light mounting brackets 11 as fitted to a fluorescent light bulb 14. It shall be noted that the light mounting brackets 11 of the invention 10 may be suited for use with other types of light bulbs, such as Halogen light bulbs, incandescent light bulbs, etc.

Each light mounting bracket 11 connects to one another by electrical wiring 15. The electrical wiring 15 also connects to the watt reducer 12. the watt reducer 12 is included in order to adjust the amount of light produced by the light bulbs 14 by varying the wattage supplied via the electrical wiring 15. The watt reducer 12 is wired to a power source (not depicted).

Figure 4:
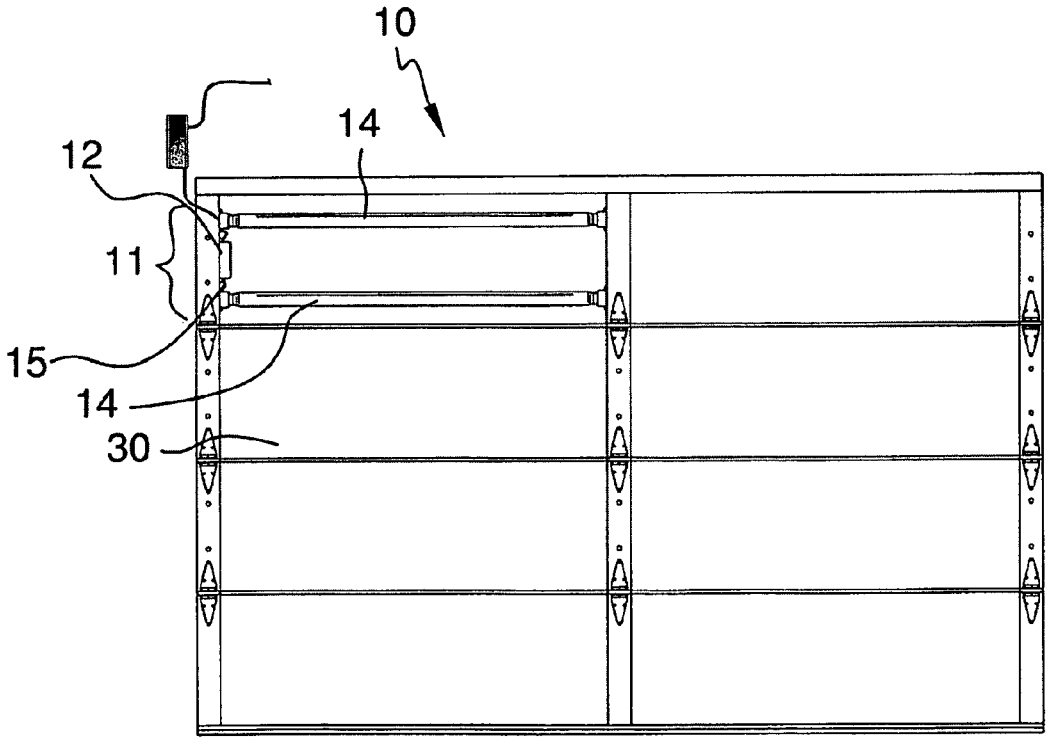
FIG. 4 illustrates a view of the invention installed on a typical garage door.
Figure 5:
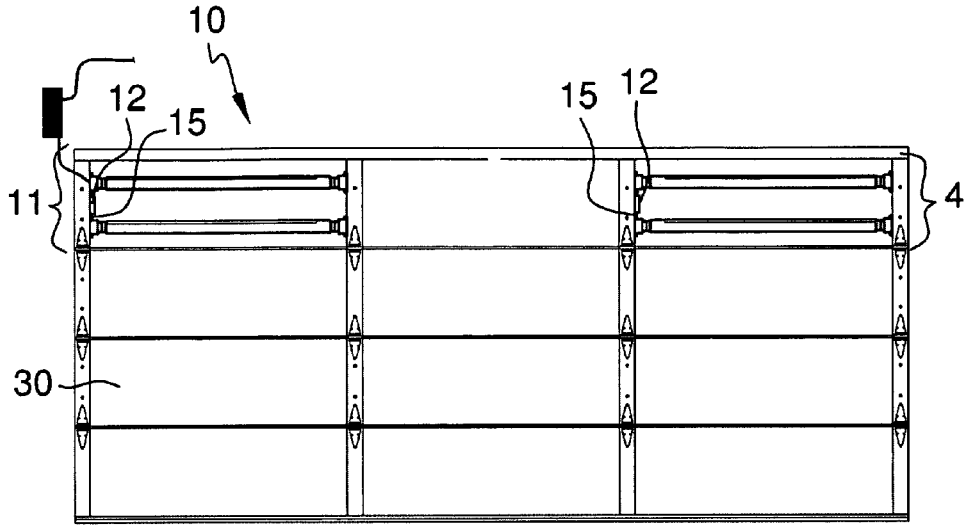
FIG. 5 illustrates a view of the invention installed on a large garage door.
Figure 6:
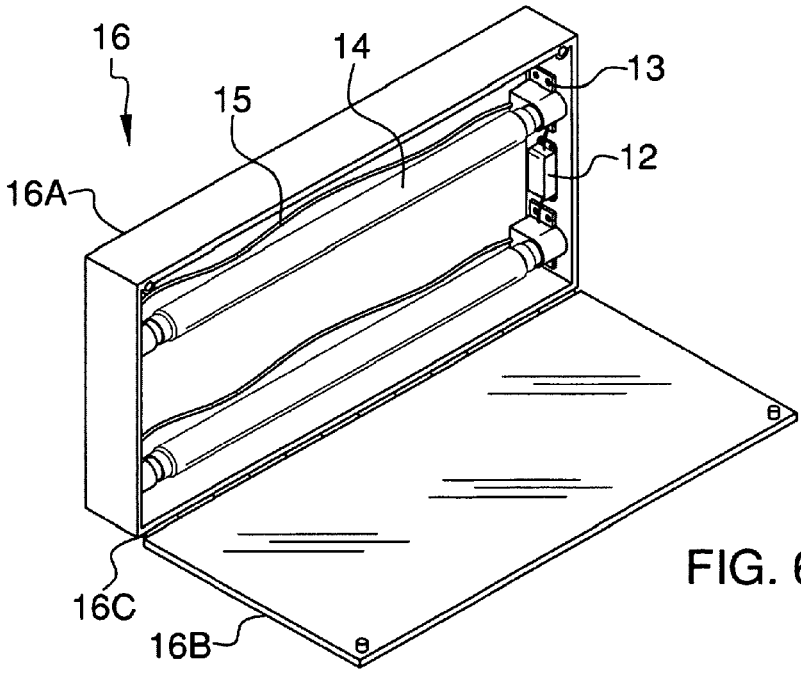
FIG. 6 illustrates a view of the lighting box.

Referring to FIGS. 4 and 5, the invention 10 may incorporate more light mounting brackets 11 and corresponding light bulbs 14 depending on the size of the garage door 30. It shall be further noted that the location of the light mounting brackets 11 with respect to the garage door 30 is best suited for the upper portion of the garage door 30 as depicted in FIGS. 4 and 5. However, light mounting brackets 11 may be installed at all elevations along the garage door 30 as need by the end user.

A lighting box 16 may be provided for each location that has a light bulb 14 or light bulbs 14. The lighting box 16 has a box 16A, a lighting cover 16B that is connected to the box 16A by a hinge 16C. It shall be further noted that the lighting cover 16B shall be made of a clear material.

Located along the interior of the box 16A is the watt reducer 12, light mounting brackets 12, light bulbs 14, and electrical wiring 15.

Figure 7A:
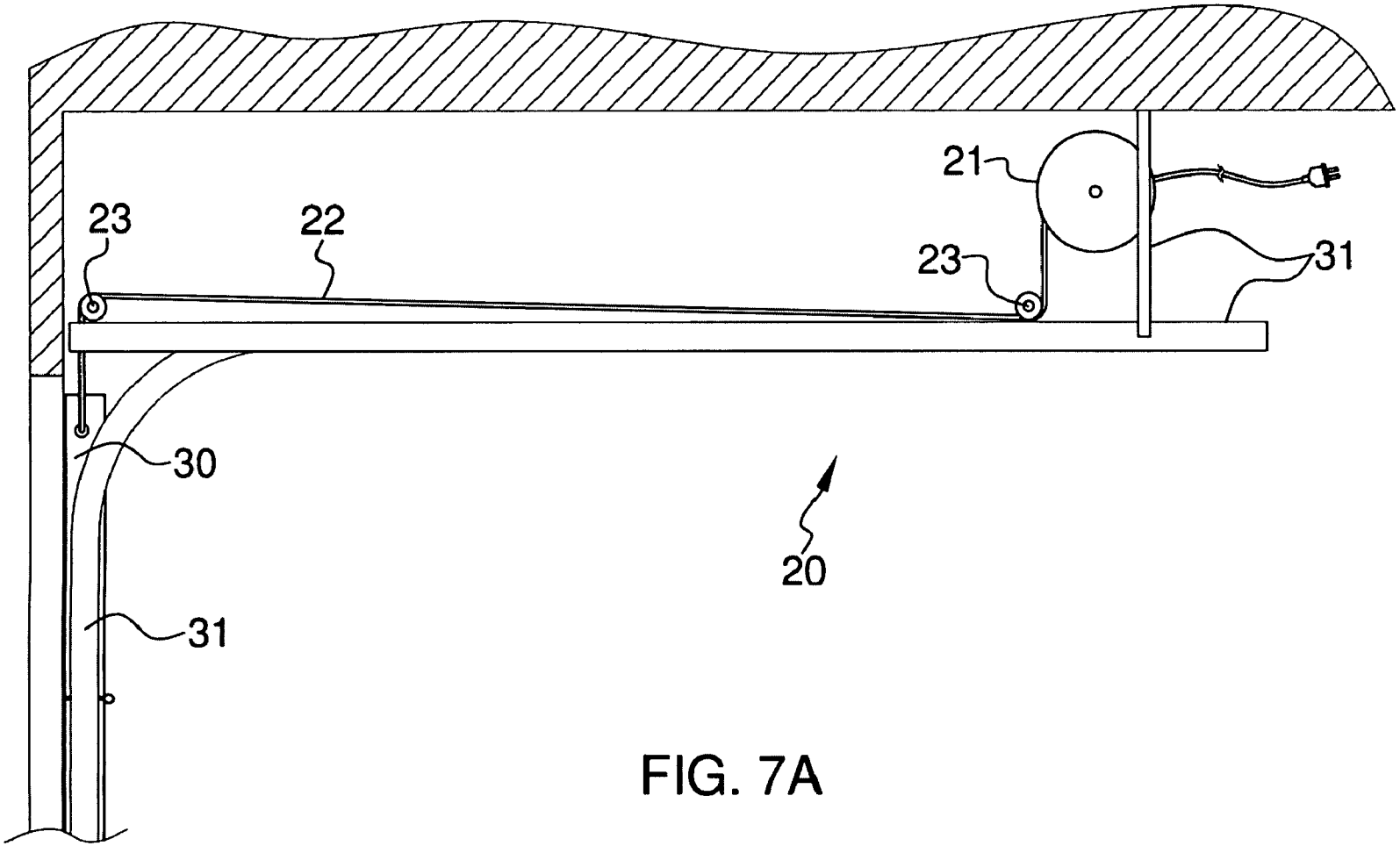
FIG. 7A illustrates a side view of the spring-loaded electrical wiring system attached to the garage door in the closed position.
Figure 7B:
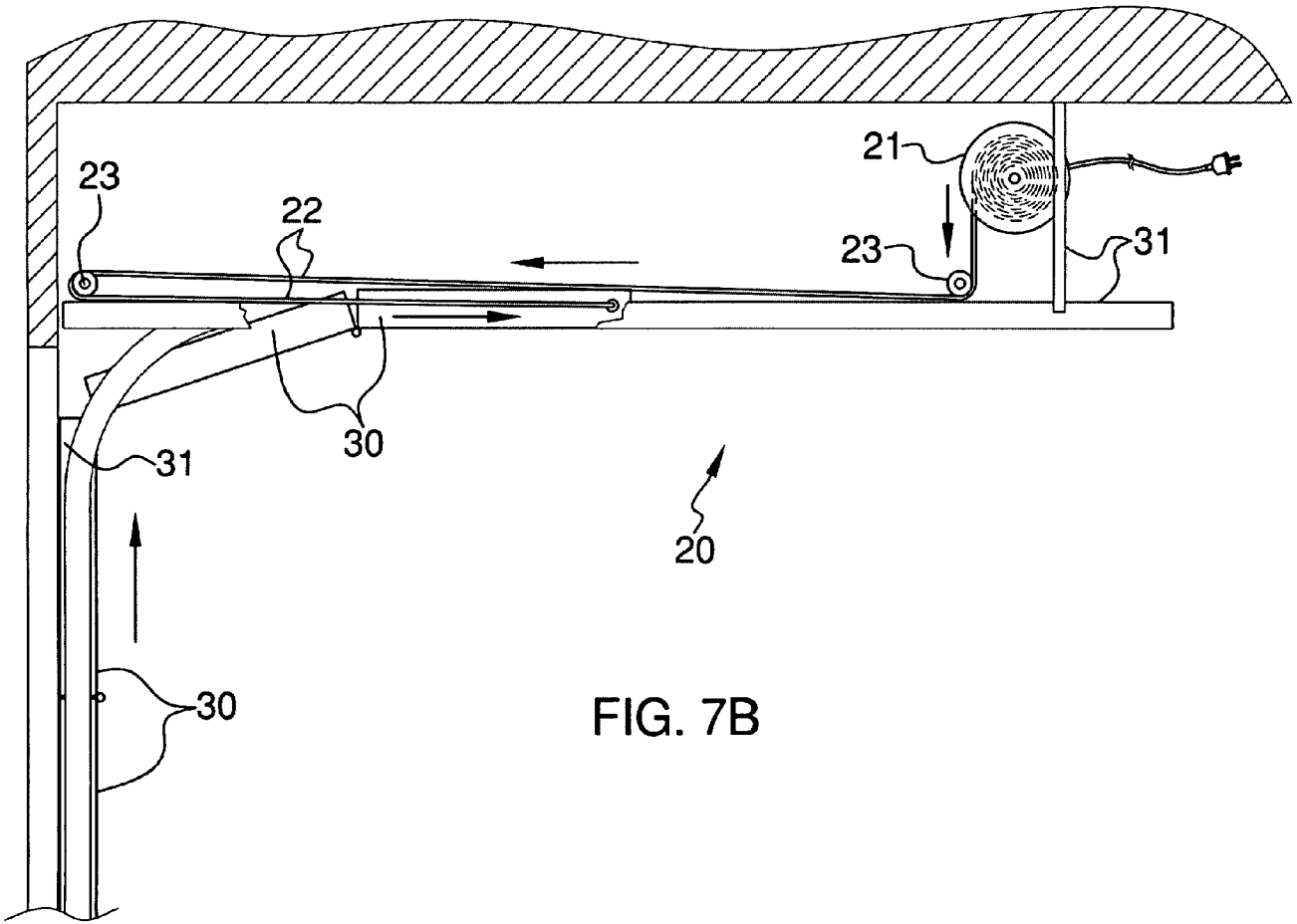
FIG. 7B illustrates a side view of the garage door track and rail cutaway to depict the spring-loaded electrical wiring system attached to the garage door as the garage door is opening.
Figure 7C:
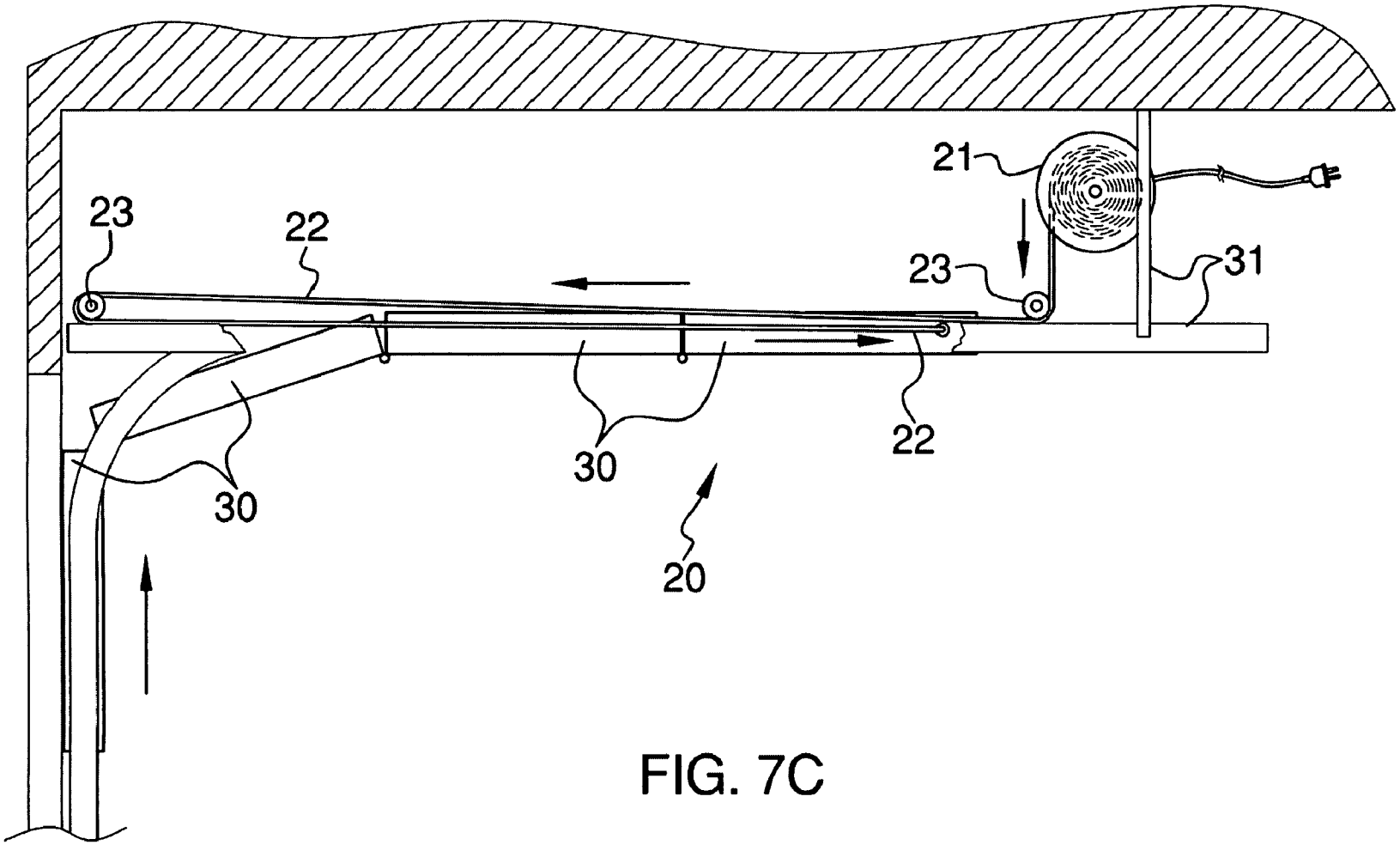
FIG. 7C illustrates a side view of the garage door track and rail cutaway to depict the spring-loaded electrical wiring system attached to the garage door in the open position.

The electrical wiring 15 connects to a spring-loaded electrical wiring system 20, which includes a spring-loaded creel 21, an electrical wire 22, and a plurality of pulleys 23. The pulleys 23 and the spring-loaded creel 21 are mounted to a garage door track and rail 31. Referring to FIGS. 7A-7C, the electrical wire 22 extends from the spring-loaded creel 22 around the pulleys 23, and over to the wiring 15 located on the garage door 30.

It is being asserted that the spring-loaded electrical wiring system 20 is an object of the overall invention 10 in that electrical power can be supplied to the invention 10 irregardless of the position or movement of the garage door 30.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous, adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A garage door illumination kit comprising:

(a) a plurality of light boxes;

wherein each lighting box attaches to the inner surface of a garage door by a fastening means;

wherein each lighting box has a plurality of mounting brackets;

wherein the light mounting brackets have fixtures for attaching a light bulb;

(b) a watt reducer;

wherein the watt reducer is electrically wired to all of the light mounting brackets;

(c) a spring-loaded electrical wiring system further comprising a creel, an electrical wire, and a plurality of pulleys;

wherein the pulleys and the spring-loaded creel are mounted onto a garage door track and rail of a garage door;

wherein the electrical wire of the spring-loaded electrical wiring system connects along end to the electrical wiring of the garage door illumination kit;

wherein the opposite end of the electrical wire of the spring-loaded electrical wiring system connects to an electrical supply;

wherein the spring-loaded electrical wiring system provides a continuous supply of electricity to the light bulbs regardless of whether a garage door is open, closed, opening, or closing; and wherein the garage door illumination kit provides interior lighting for the garage.

2. The garage door illumination kit as described in claim 1 wherein the mounting box further comprises a box and a cover, which attaches to and opens from the box via a hinge.

3. The garage door illumination kit as described in claim 2 wherein the fastening means comprises screwing, nailing, riveting, bolting, gluing, magnets, or welding.

4. The garage door illumination kit as described in claim 3 wherein the light bulb that attaches to the light mounting bracket may be a fluorescent bulb, a Halogen bulb, or an incandescent light bulb.

* * * * *